United States Patent [19]

Bruno et al.

[11] 4,057,424

[45] Nov. 8, 1977

[54] ZINC-BASED ALLOY FOR COATING STEEL

[75] Inventors: Roberto Bruno; Massimo Memmi; Paolo Berardi; Augusto Musso, all of Rome, Italy

[73] Assignee: Italsider S.p.A., Italy

[21] Appl. No.: 689,911

[22] Filed: May 25, 1976

[30] Foreign Application Priority Data

June 13, 1975 Italy ..... 50042/75

[51] Int. Cl.[2] ..... C22C 18/04

[52] U.S. Cl. ..... 75/178 A; 427/433; 428/659

[58] Field of Search ..... 75/178 A, 178 AM, 178 R; 29/196.5; 428/689; 427/433

[56] References Cited

U.S. PATENT DOCUMENTS

| | | | |
|---|---|---|---|
| 1,815,479 | 7/1931 | Morell | 75/178 AM |
| 2,180,291 | 11/1939 | Finkeldey | 75/178 A |
| 2,195,566 | 4/1940 | Gifford et al. | 75/178 A |
| 2,222,157 | 11/1940 | Ruzicka | 75/178 A |
| 2,700,647 | 1/1955 | Welcker | 75/178 R X |
| 3,245,765 | 4/1966 | Lawson | 29/196.5 |
| 3,320,040 | 5/1967 | Roe et al. | 29/196.5 |
| 3,505,042 | 4/1970 | Sievert et al. | 29/196.5 X |
| 3,993,482 | 11/1976 | Bruno | 75/178 A |

*Primary Examiner*—Arthur J. Steiner

*Attorney, Agent, or Firm*—Robert E. Burns; Emmanuel J. Lobato; Bruce L. Adams

[57] ABSTRACT

The present invention relates to a zinc-based alloy for coating steel and products coated therewith. More exactly, the invention relates to a low-alloy zinc suitable for the continuous coating of steel, particularly in the form of sheet and wire, on Sendzimir coating lines and to the products coated with said alloy.

2 Claims, 12 Drawing Figures

ZINC-BASED ALLOY FOR COATING STEEL

BACKGROUND OF THE INVENTION

It is well known that there are many applications for which common steel cannot be used unless it has a protective coating, because of its low corrosion resistance. One of the most important of the many methods of protecting such a steel is to coat it by dipping it in a molten bath of metal, particularly of zinc and its alloys.

The corrosion behavior and mechanical properties of products with zinc-based coatings depend largely on the conditions under which the galvanizing is done and the composition of the molten bath. Particularly, bath composition largely governs the growth of the brittle phases at the base/coating interface and the chemical stability of the external phase (known as the h phase) of the coating, which largely controls the corrosion behavior of the galvanized piece.

The most widely used bath consisting essentially of zinc give rise to numerous problems as regards the brittleness of the resulting coatings and the corrosion resistance thereof, particularly in atmospheres where there are chlorides or sulphur-based acids (derived from SO2, H2S, etc.).

Numerous coating alloys have been developed to overcome these difficulties. They can be classed as high, medium and low-percentage alloys.

An example of a high-percentage alloy is one containing about 50% aluminum, described in U.S. Pat. No. 3,393,089 in the name of Bethlehem Steel. The resulting coated product, sold under the trade name "Galvalume," has a very good corrosion resistance.

Medium-percentage alloys include, for instance, a zinc alloy with 3% Mg and 4.4% Al, British Pat. No. 1,125,965 and a Zn alloy with 3% Mg and 1% Al, Belgian Pat. No. 814,696; this latter in the name of Centro Sperimentale Metallurgico Spa., describes an alloy for coating ferrous materials, which is particularly resistant to localized corrosion and polarity reversal in hot water, and is especially suitable for coating pipes.

Then there are zinc-based alloys with a low percentage of alloying elements, e.g., British Pat. No. 1,057,285 in the name of Armco Steel Co. describes one with 0.04–0.35% Al and 0.01–0.1% Mg.

At present, continuous coating lines for sheet and wire, the Sendzimir process is used; this generally utilizes an alloy containing 0.15–0.30% Al and around 0.2% Pb. In recent years, this process has gained steadily in importance because of the increasing tendency to form light and medium-weight sections from flat galvanized steel, which is bent and formed into box sections.

However, the products obtained at present with the Sendzimir process do not have satisfactory corrosion-resistance properties. For instance, they will not withstand attacks in chloride or sulphur-acid atmosphere, nor they are resistant to underfilm corrosion.

Though much study was effected about this problem, so far no one appears to have producted a galvanizing alloy capable of replacing that used industrially in the Sendzimir process, without needing substantial modifications to the plant and process, and which is also capable of improving the corrosion resistance of the products obtained and for broadening their fields of use.

OBJECTS OF THE INVENTION

In view of the foregoing, the invention aims at achieving the following objects:

to remove the above drawbacks;

to provide a dip-galvanizing alloy which can be used on continuous coating lines of the Sendzimir type without needing any particular modification in the plant or process;

to provide a dip-coating alloy which may increase the corrosion-resistance of the coated products and allow their application even in places and under conditions that have so far been out of question for Sendzimir coated products (e.g., bent, riveted or nailed structures — underfilm corrosion) or those used in chloride-rich atmospheres (marine environment), while ensuring better electrochemical protection of ferrous base areas that accidentally happen to remain without any coating (sacrificial anode function).

BRIEF DESCRIPTION OF THE DRAWINGS

In order that the invention may be clearly understood, it will now be described, by way of example, with reference to the accompanying drawings, wherein.

DESCRIPTION OF THE PREFERRED EMBODIMENT

Figure 1A:
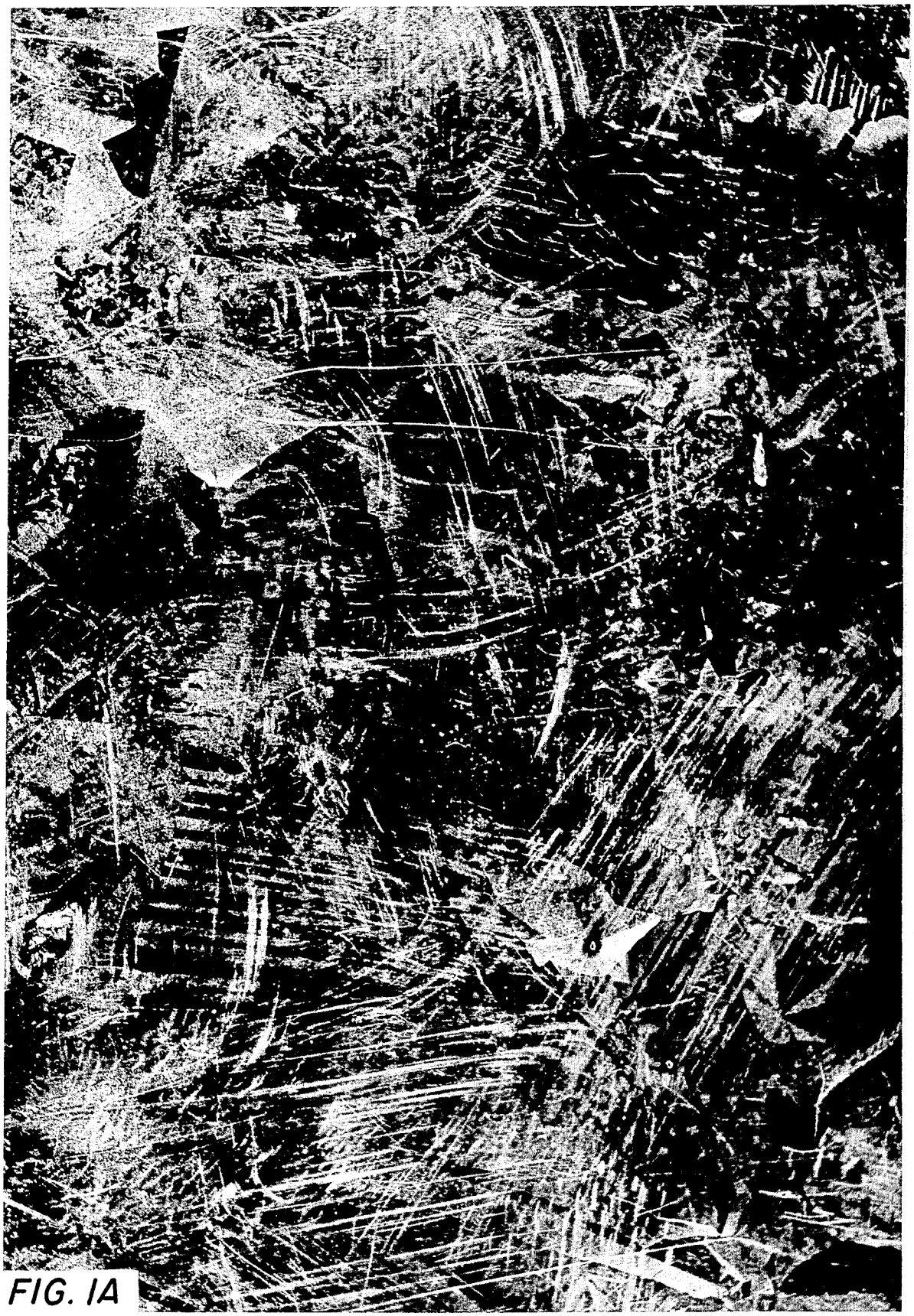
FIG. 1A shows a test specimen coated with the alloy normally used in the Sendzimir process.

In developing the zinc-based alloy according to the present invention account was taken of the need to: replace the alloy generally used in the Sendzimir process (Zn, 0.2% Al and 0.2% Pb) without any substantial changes in the plant or process, especially as regards the bath immersion times; increase the corrosion resistance of the coated product; widen the fields of use of the coated product.

During the studies which led to the present invention, the behavior of various alloying elements was examined. Particularly, the following facts emerged, some of which have already been reported in the technical literature:

lead is extremely dangerous for all corrosion conditions;

aluminum is important as it controls air oxidation of the molten bath and as it reduces the rate of formation of brittle phases at the ferrous base/coating interface;

chromium increases the corrosion resistance in acid atmospheres, especially in weakly acid ones typical of underfilm corrosion (bending, nailing, etc.); magnesium is extremely beneficial in providing protection against intergranular corrosion and chloride attack and in assuring galvanic protection; titanium is generally capable of increasing the corrosion resistance in various aggressive atmospheres.

However, the use of these elements alloyed with zinc to obtain an alloy which may meet the objects of the present invention is not as simple and straightforward as it may seem, since not only do they have the advantages just listed, they also have many drawbacks. As a result, the studies which led up to this invention were fraught with difficulties.

The disadvantages and drawbacks may be resumed as follows:

aluminum facilitates intergranular corrosion of the coating layer;

chromium is difficult to dissolve in the bath, increases the melting temperature of the alloy as well as the hardness and brittleness of the coating and facilitates the brittle intermetallic phases to form;

magnesium is difficult to add to the bath because it is so readily oxidized; titanium is difficult and slow to dissolve in the bath.

It was particularly difficult to overcome the unfavorable behavior of aluminum and chromium, but finally it was obtained in the alloy according to the invention by having the following range of composition (by weight): Al 0.10–0.30%, Mg 0.30–0.80%, Cr 0–0.20%, Ti 0–0.20%, the rest being essentially zinc. The following ratios must be respected within this range of composition:

Mg/Al 4 or less, preferably between 2.5 and 4; Cr/Al 1.5 or less and the desired results are not obtained outside these limits.

The various alloys studied are set forth in Table 1, where Series No. 1 consists of specimens coated in the usual way; Nos. 2 to 5 consist of specimens coated with the alloys as per the invention; Nos. 6 to 9 consist of alloy compositions close to that of the invention, but nevertheless outside the range, to show how critical the particular composition of the alloy is.

Table 1: A common, rimmed steel in form of a thin sheet was coated with all the alloys set forth in Table 1, using the Sendzimir process, i.e.: surface oxidation in air at 500° C, reduction of oxides at 900° C in hydrogen atmosphere, cooling to bath temperature and immersion in bath for between 3 and 5 seconds to obtain a coating between 25 and 35 microns thick, on average.

The following experimental tests were effected on the specimens so obtained:

exposure in salt-spray chamber, 5 NaCl (S.S.C. 5%); exposure in S.S.C. 5% followed by pickling in 20% chromic acid to remove the products of corrosion;

exposure in S.S.C. 5% after deep forming;

exposure in S.S.C. 5% after painting and scratching;

alternate immersion in sea water; exposure to distilled water steam at 100° C.

The tests involving exposure in S.S.C. 5% (exposure of specimens to a spray containing 5% sodium chloride in an atmosphere thermostatically controlled at 30° C) lasted for 300 hours in the case of the specimens coated with control alloy No. 1 and 1500 hours for the other specmens.

The tests involving immersion in man-made seawater consisted in 300 complete cycles of 30 minutes immersion followed by exposure to air for 120 minutes. The loss of weight of the specimen was defined after the 300 cycles.

The tests involving exposure to steam (intergranular corrosion) consisted in keeping the specimens for ten days in a stream of distilled water steam at a temperature of between 95° and 100° C.

Figure 1B:
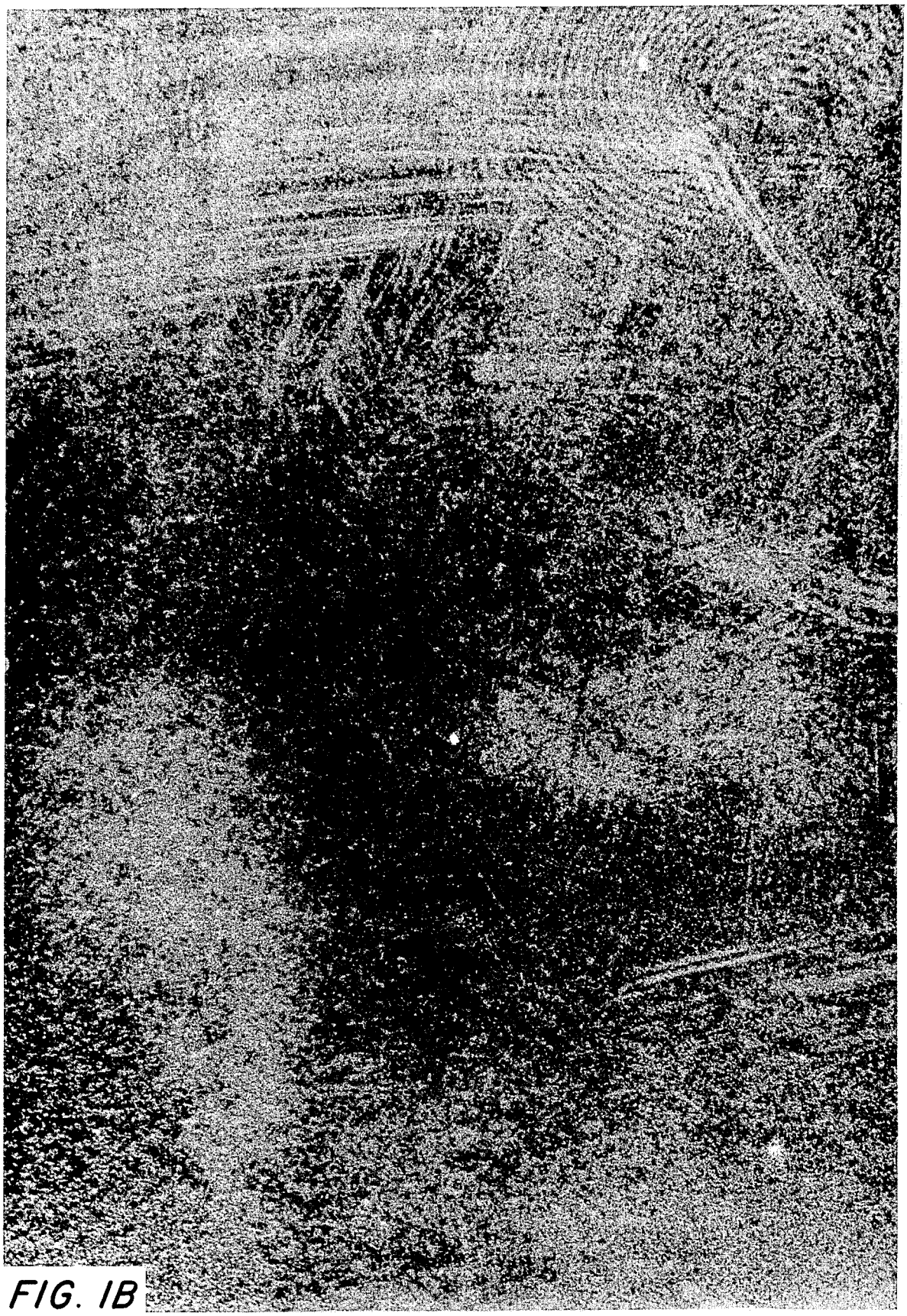
FIG. 1B shows a test specimen coated with an alloy as per the present invention.

In the accompanying photographic documentation, FIGS. 1A and 1B indicate a specimen coated with an alloy of control No. 1 currently used in the Sendzimir galvanizing process and a specimen coated with an alloy according to the present invention, that is Series No. 3 of Table No. 1. The difference in appearance of the two types of coating will be noted.

TABLE 1

| Series No. | Number of test specimens | Percentage composition (by weight) of elements added to the zinc | | | | | Remarks |
|---|---|---|---|---|---|---|---|
| | | Al | Cr | Mg | Pb | Ti | |
| 1 | 600 | 0.20 | — | — | 0.17 | — | Control alloy used in Sendzimir hot-dip lines |
| 2 | 100 | 0.25 | — | 0.80 | — | — | |
| 3 | 100 | 0.20 | 0.16 | 0.55 | — | — | Bath easy to be prepared using a Zn-Cr base alloy |
| 4 | 100 | 0.10 | 0.15 | — | — | — | Bath easy to be prepared using a Zn-Cr base alloy |
| 5 | 100 | 0.22 | — | 0.40 | — | 0.15 | Ti slow to dissolve |
| 6 | 50 | 0.08 | 0.23 | 0.40 | — | — | Abundant slag formation. Non-uniform coating with slag inclusions. |
| 7 | 50 | 0.08 | — | 0.26 | — | 0.24 | Abundant slag formation. Non-uniform coating |
| 8 | 50 | — | 0.38 | 0.24 | — | ' | Excessive slag formation. Very brittle, non-uniform coating. Bath preparation difficult. |
| 9 | 50 | 0.15 | 0.25 | — | — | 0.21 | Bath difficult to be prepared, Brittle coating. |

FIGS. 2A and 2B, 3A and 3B, 4A and 4B and 5A and 5B show specimens similar to those in FIGS. 1A and 1B after tests involving exposure to S.S.C. 5%. It is evident how severe the corrosion of the A specimens is (coated with the control alloy No. 1 of Table 1) after only 300 hours exposure, while the B specimens (coated with the Ser. No. 3 alloy of Table 1) are still in excellent condition after 1500 hours.

Figure 2A:
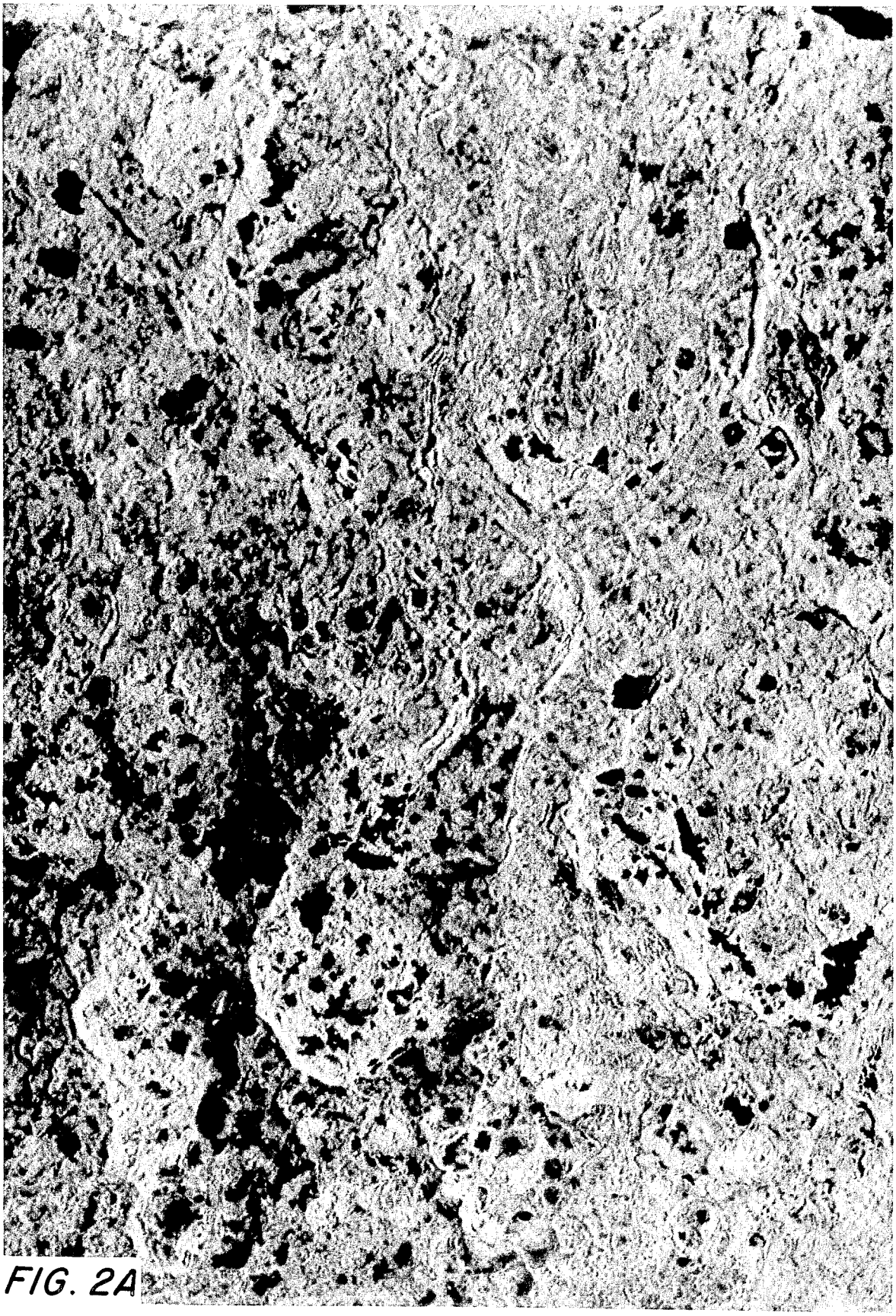
FIG. 2A shows a specimen similar to the one of FIG. 1A after 300 hours exposure in a salt-spray chamber 5% NaCl (S.S.C 5%)
Figure 2B:
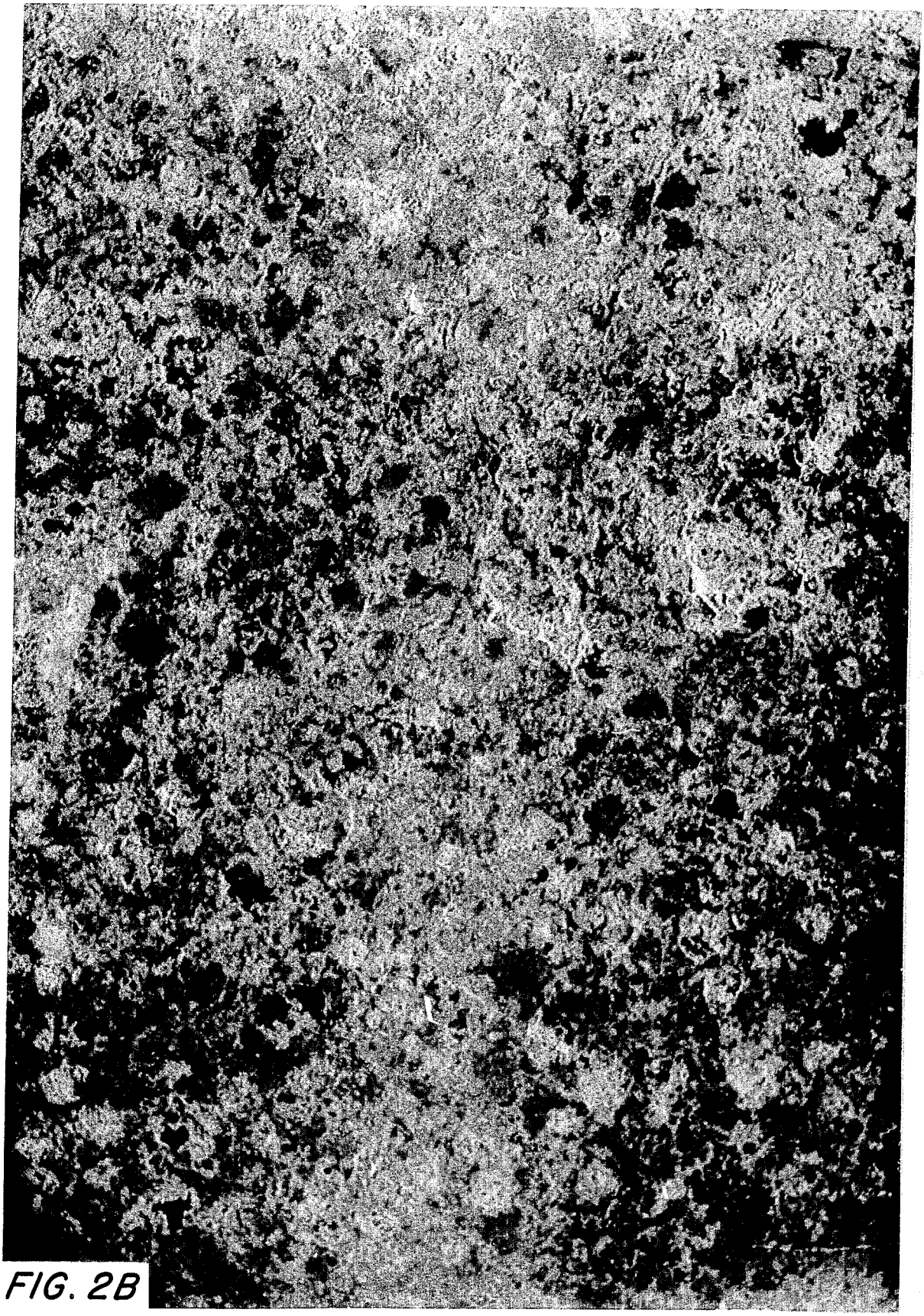
FIG. 2B shows a specimen similar to the one of FIG. 1B after 1500 hours exposure in S.S.C. 5%.
Figure 3A:
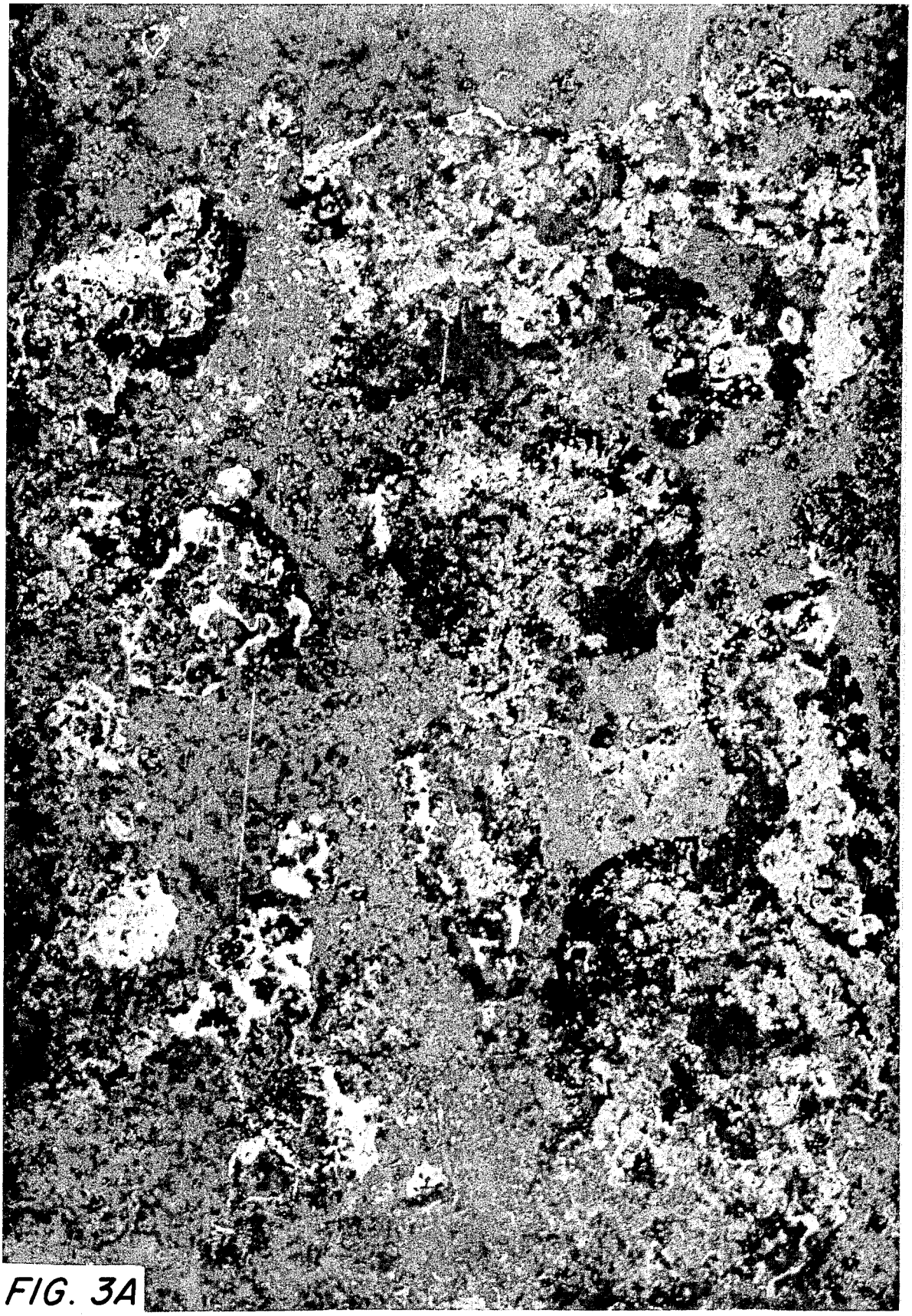
FIG. 3A shows the FIG. 1A specimen after 300 hours exposure in S.S.C. 5% followed by removal of the corrosion products by pickling in 20% chromic acid.
Figure 3B:
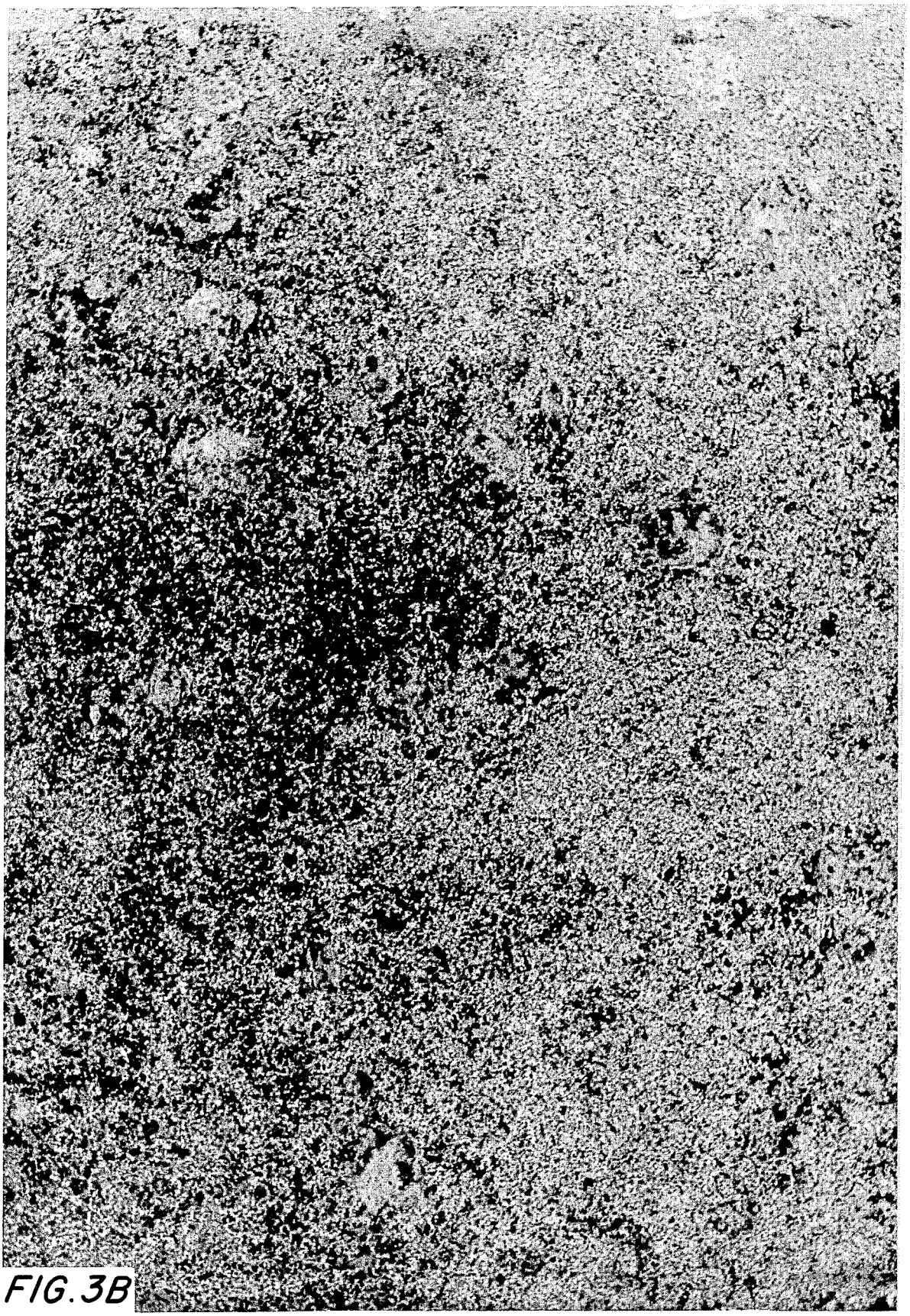
FIG. 3B shows the FIG. 1B specimen after 1500 hours exposure in S.S.C. 5% followed by removal of the corrosion products by pickling in 20% chromic acid.
Figure 4A:
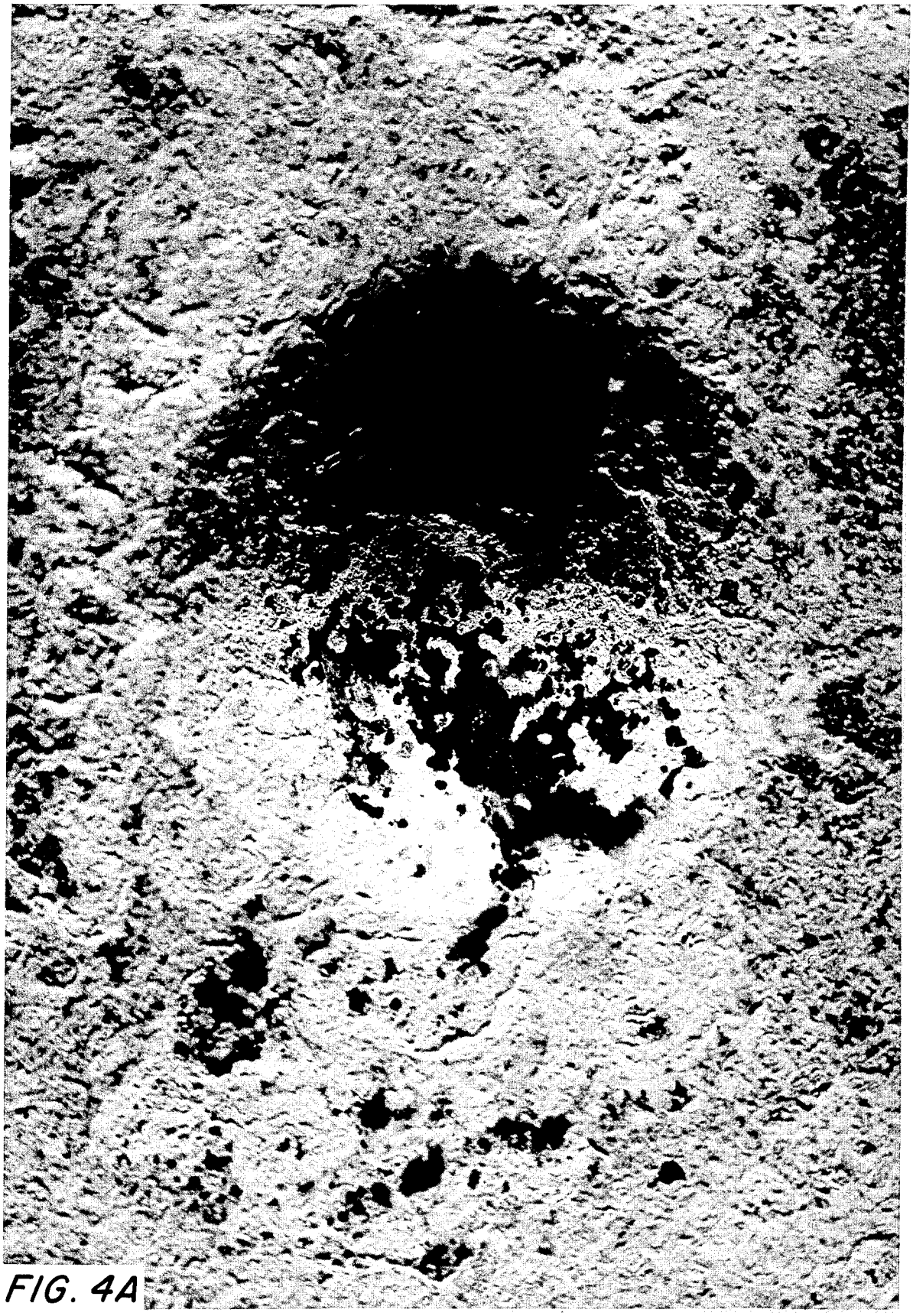
FIG. 4A shows a specimen similar to the one of FIG. 1A, deep drawn and exposed in S.S.C 5% for 300 hours.
Figure 4B:
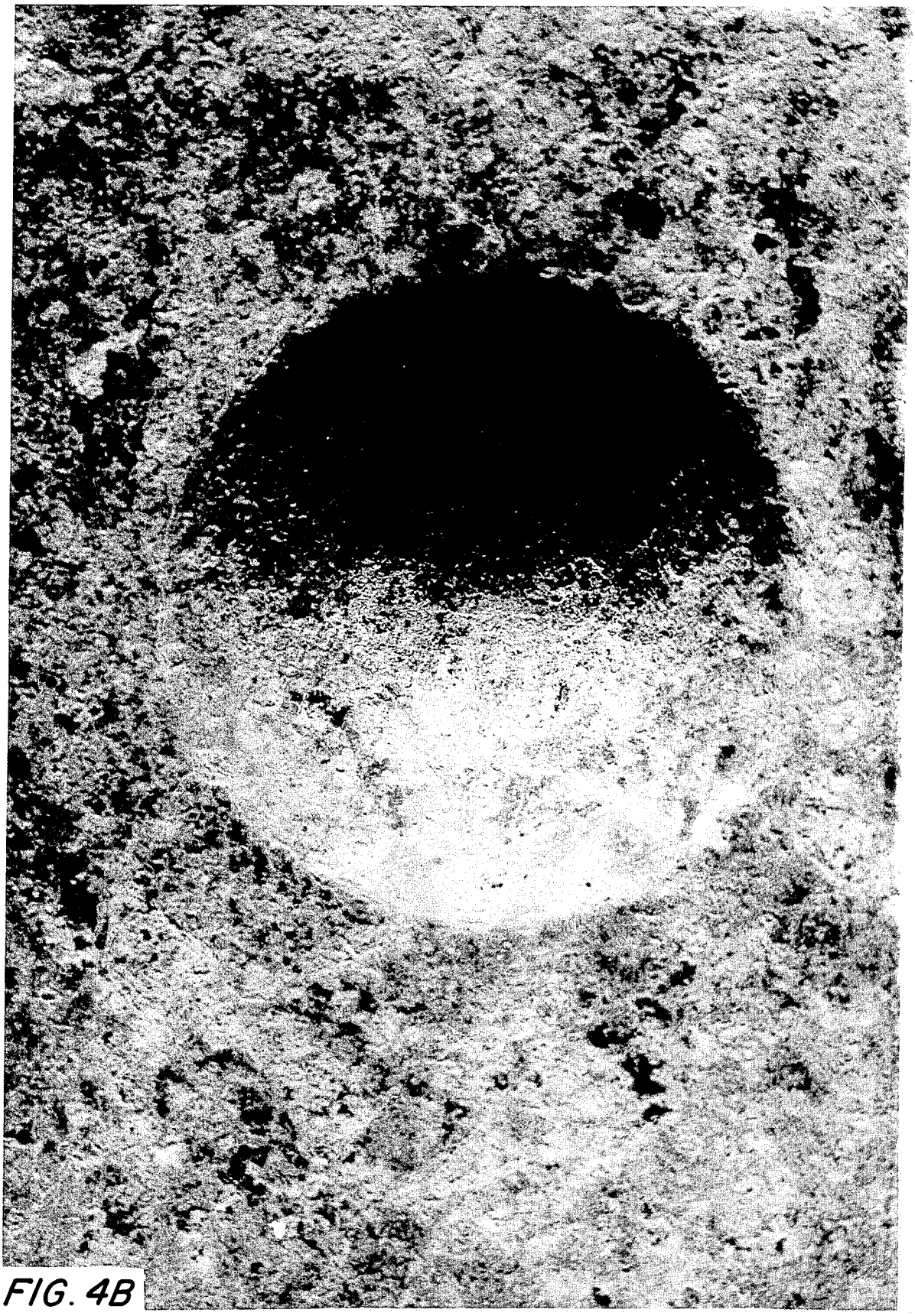
FIG. 4B shows a specimen similar to the one of FIG. 1B, deep drawn and exposed in S.S.C. 5% for 1500 hours.
Figure 5A:
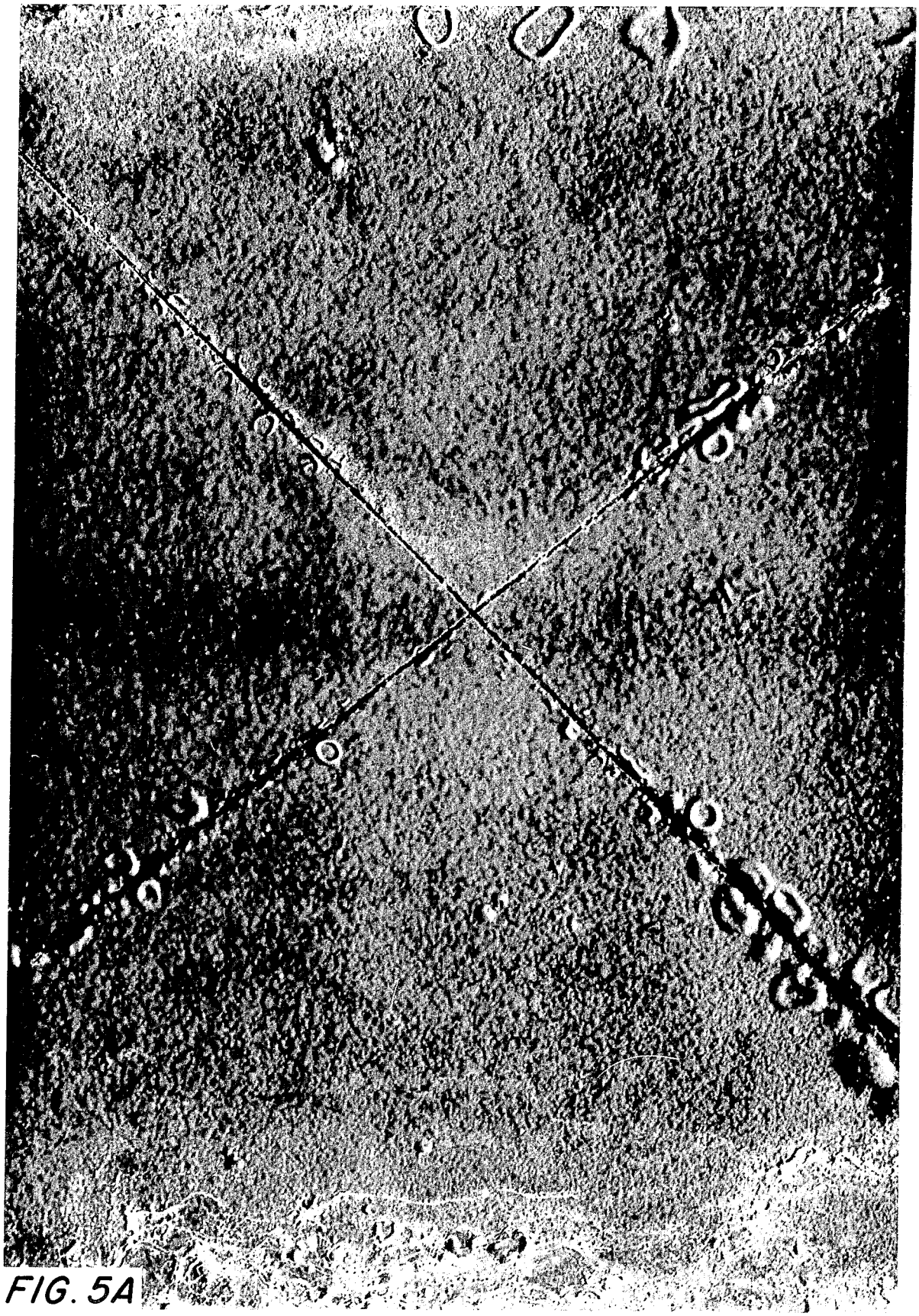
FIG. 5A shows the specimen similar to the one of FIG. 1A, painted, scratched and exposed in S.S.C. 5% for 300 hours.
Figure 5B:
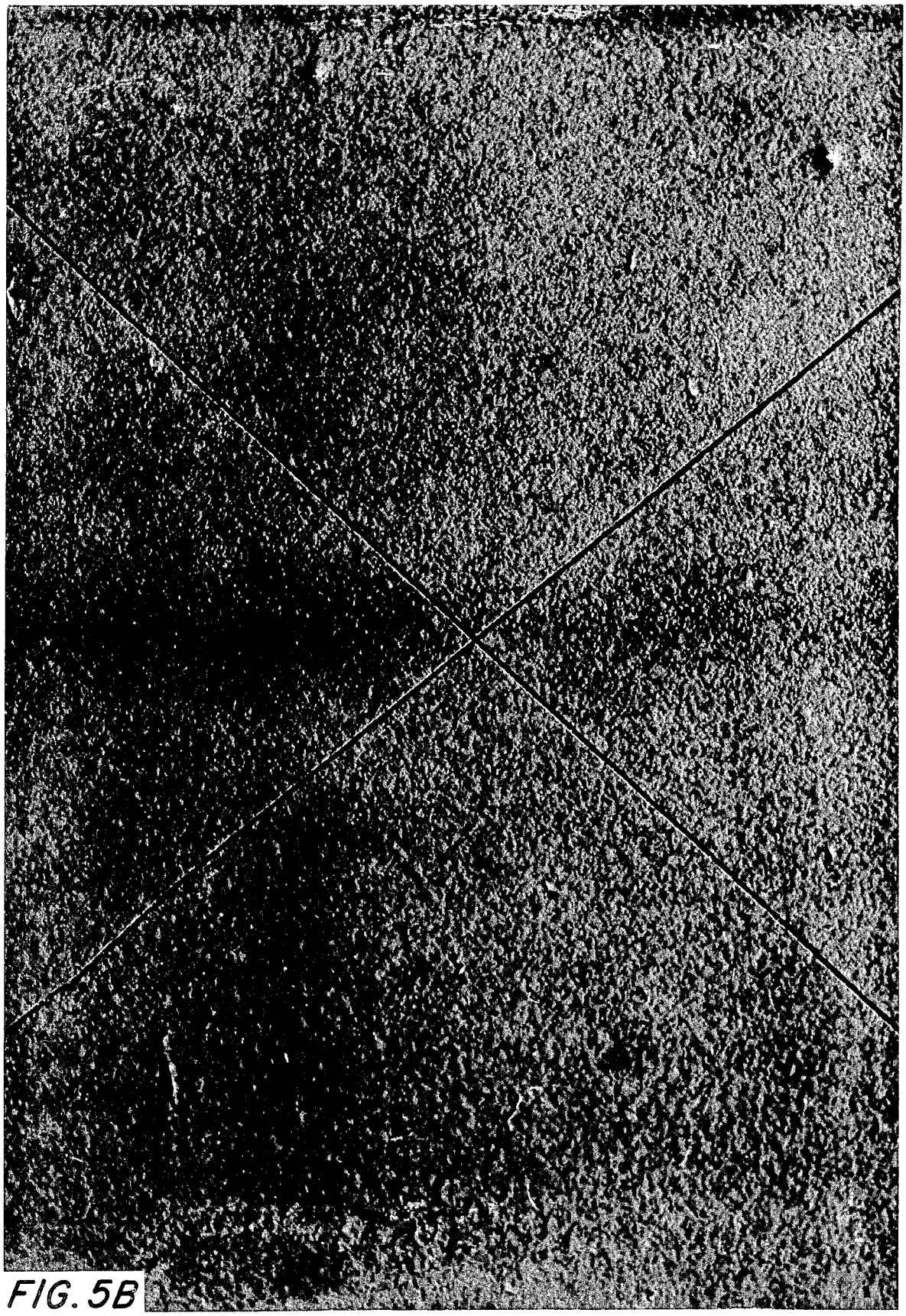
FIG. 5B shows a specimen similar to the one of FIG. 1B, painted, scratched and exposed in S.S.C. 5% for 1500 hours.

FIGS. 3A and 3B show the same specimens as FIGS. 2A and 2B after pickling in 20% chromic acid to remove the products of corrosion.

It is apparent from FIG. 3A that after 300 hours exposure the specimen coated with the control alloy had lost all its coating, while the specimen coated with the Ser. No. 3 alloy according to the present invention has still its coating intact after 1500 hours exposure.

The results of the loss of weight tests after 300 hours in S.S.C. 5% and after 300 cycles of dipping in man-made sea water are given in Table 2.

The alloys are the same as in Table 1.

TABLE 2

| Coating alloy series No. | Coating thickness in microns | Thickness of brittle phase as % of coating thick. | S.S.C. 5% p mg/cm² Min | Max | Med | Alternate Imm. p mg/cm² Min | Max | Med |
|---|---|---|---|---|---|---|---|---|
| | | | + | + | + | + | + | + |
| 1 | 24–28 | 10 | 16.3 | 19.6 | 18.9 | 11.6 | 16.4 | 14.3 |
| 2 | 25–28 | 4 | 5.6 | 7.6 | 6.2 | 4.6 | 5.6 | 5.3 |
| 3 | 24–30 | 4 | 3.4 | 5.5 | 3.9 | 2.8 | 4.9 | 3.4 |
| 4 | 25–35 | 7 | 5.8 | 8.2 | 6.2 | 4.7 | 6.6 | 5.8 |
| 5 | 24–30 | 8 | 5.6 | 8.0 | 6.6 | 4.9 | 6.8 | 5.8 |
| 6 | 25–35 | 10 | 14.6 | 18±8 | 17±6 | 10.1 | 16.2 | 13.9 |
| 7 | 26–33 | 10 | 16.2 | 20±1 | 18±8 | 10.8 | 15.8 | 15.1 |
| 8 | 28–35 | 20 | 16.4 | 20±2 | 19±6 | 12.6 | 16±4 | 14.9 |
| 9 | 22–28 | 20 | 15±8 | 18±9 | 17±8 | 12.6 | 18±4 | 16±3 |

(Note + = Extensive rust marks over practically the whole surface of the specimen)

Figure 6A:
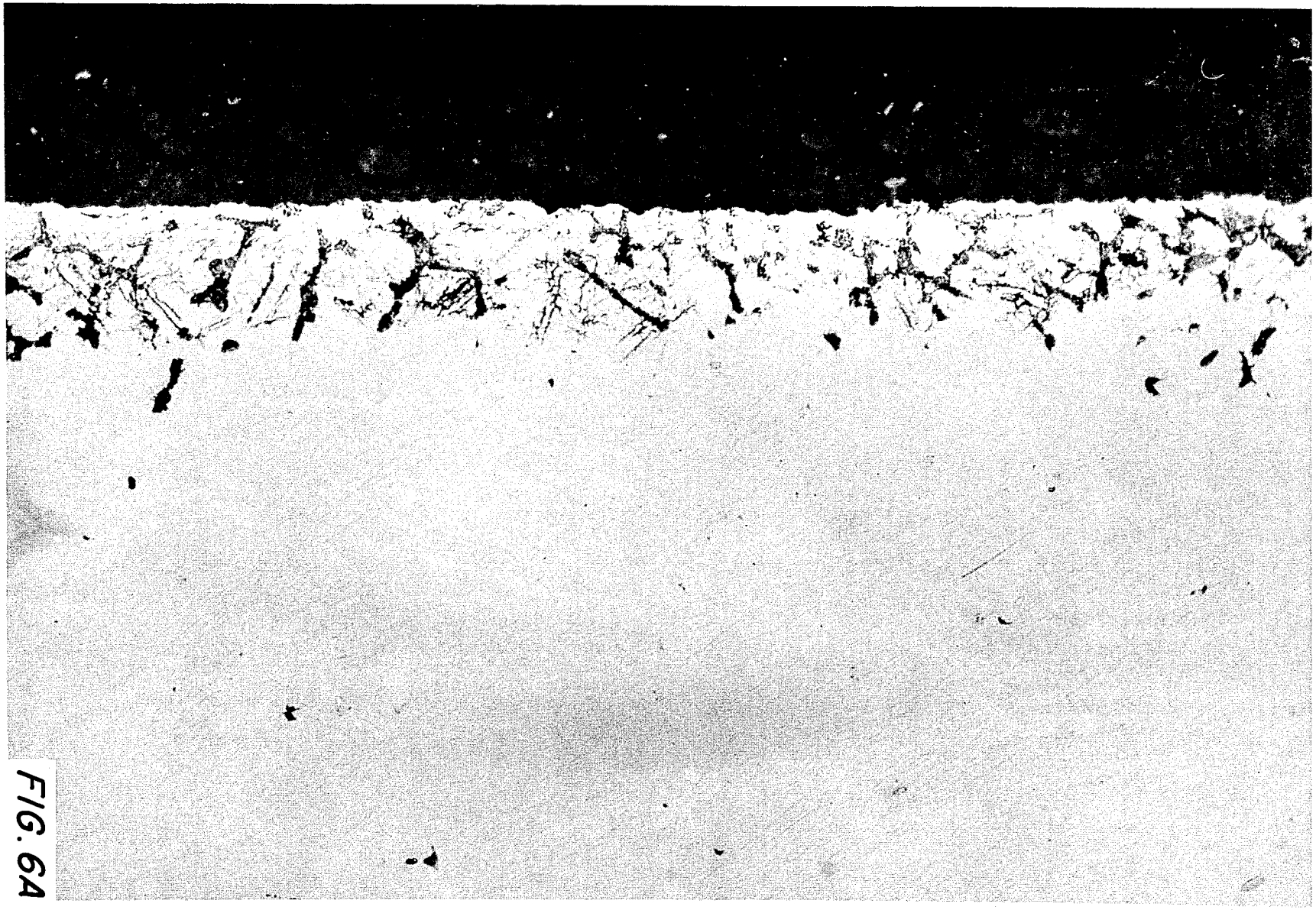
FIG. 6A shows a micrograph (× 250) of a section of a specimen coated with the alloy used in the normal Sendzimir process, after exposure to distilled water steam at 100° C for 10 days.
Figure 6B:
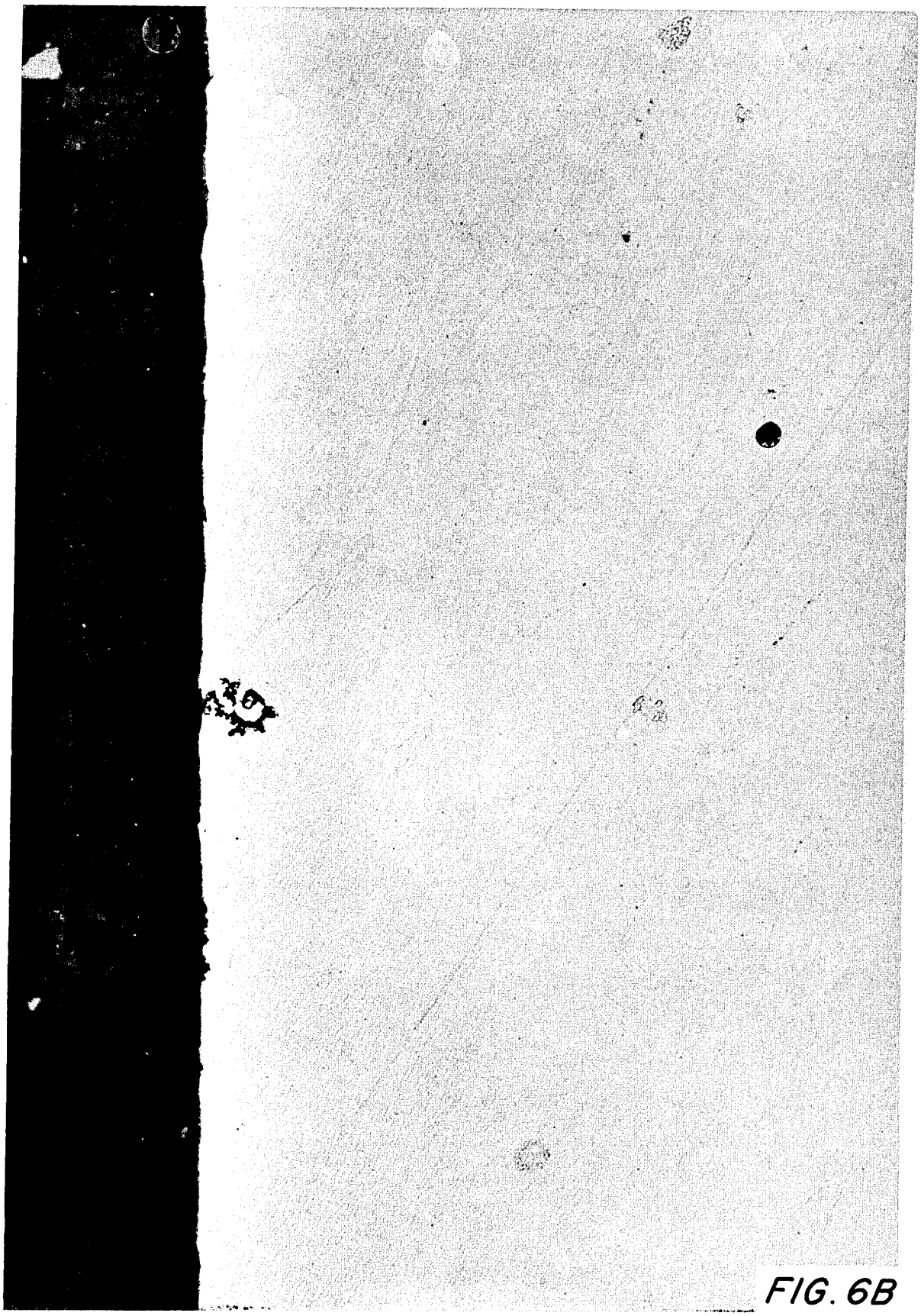
FIG. 6B shows a micrograph (× 250) of a section of a specimen coated with an alloy as per the present invention, after exposure to distilled water steam at 100° C for 10 days.

Table 2: the great improvement in intergranular corrosion resistance when the specimen is coated with the alloys according to the present invention is apparent from FIGS. 6A and 6B: the control alloy (A) has been severely corroded, while that according to the present invention (B) exhibits virtually no corrosion.

The documentation and the tables underline not only the great improvement in corrosion resistance obtained when using alloys according to the invention, but also the critical nature of the range of composition of the alloys which are the object of the present invention.

By comparing the results obtained with alloys of Ser. Nos. 2 to 5 with those of Ser. Nos. 6 to 9 shown in Tables 1 and 2, it is apparent that if the Al content is brought even slightly below the minimum permitted there is abundant formation of slag on the bath and the resulting coating lacks uniformity and provides little protection.

Further, if the Mg content is brought below 0.30% intergranular corrosion becomes serious and loss of weight is high.

It may also be added that if the amounts of Al and Mg are increased to above the percentages specified in this specification, it is still possible to obtain excellent protective alloys (see Belgian Pat. No. 814.696, for instance), but they cannot be used in the Sendzimir process without costly changes to plant and process, since they involve quite a marked increase in bath temperture and substantial modifications in immersion times for the sheet and wire in the bath.

It is to be understood that the invention is not limited to the examples shown. It is intended to cover all modifications and equivalents within the scope of the appended claims.

What we claim is:

1. Zinc-based alloy for coating steel, particularly for continuous coating of flat steel sheet and wire using the Sendzimir process, essentially consisting of the following alloy elements in percentage by weight: Al 0.10–0.30%, Mg 0.30–0.80%, Cr 0–0.20%, Ti 0–0.20%, the balance being zinc, the ratio of Mg/AL being 4 or less and the ratio of Cr/Al being 1.5 or less.

2. The alloy of claim 1 wherein the ratio of Mg/Al is between 2.5 and 4.

* * * * *